United States Patent [19]

Smith

[11] 3,999,792

[45] Dec. 28, 1976

[54] CHILD-RESISTANT LOCK MEANS

[76] Inventor: Claude A. Smith, 415 Stony Ridge Drive, Sandusky, Ohio 44870

[22] Filed: Dec. 12, 1975

[21] Appl. No.: 640,042

[52] U.S. Cl. ..... 292/346; 292/DIG. 63

[51] Int. Cl.[2] ..... E05C 19/00

[58] Field of Search ... 292/346, 145, 189, DIG. 63, 292/DIG. 13, 336.3

[56] References Cited

UNITED STATES PATENTS

| | | | |
|---|---|---|---|
| 689,802 | 12/1901 | Haygood | 292/67 X |
| 3,109,900 | 11/1963 | Van Hook | 292/DIG. 13 |
| 3,265,424 | 8/1966 | Teopilian | 292/145 |

FOREIGN PATENTS OR APPLICATIONS

| | | | |
|---|---|---|---|
| 88,922 | 5/1960 | Denmark | 292/DIG. 13 |
| 1,206,121 | 9/1970 | United Kingdom | 292/DIG. 13 |

*Primary Examiner*—Richard E. Moore
*Attorney, Agent, or Firm*—Donnelly, Maky, Renner & Otto

[57] ABSTRACT

A child-resistant lock means characterized in that a latch, switch, or like operating member therein adapted to be actuated by the tip of the forefinger is located at the end of an angular passage so that said operating member is inaccessible for operation by the forefinger of a child. The lock means herein is further characterized in that there is a lateral projection thereon adjacent the open end of the angular passage to prevent actuation of the operating member by a slender elongated object such as a stick or pencil.

5 Claims, 6 Drawing Figures

CHILD-RESISTANT LOCK MEANS

BACKGROUND OF THE INVENTION

There are, of course, innumerable forms of lock means including key-operated locks, combination locks, flush mounted gate latch operating members which are effective in varying degree to prevent young children from opening drawers, doors, gates, etc.

SUMMARY OF THE INVENTION

The lock means herein provides a housing for a fnger-actuated operating member of a latch, a switch, or the like which has an angular passage for insertion of the forefinger with the operating member disposed at the end of the passage for actuation by the tip of the forefinger, the angular passage being such as to preclude actuation of the operating member by a child. The lock means herein further has provision to preclude actuation of the operating member by an elongated slender object such as a stick or pencil.

Other objects and advantages will appear from the ensuing description.

DETAILED DESCRIPTION OF THE PREFERRED EMBODIMENT

Figure 1:
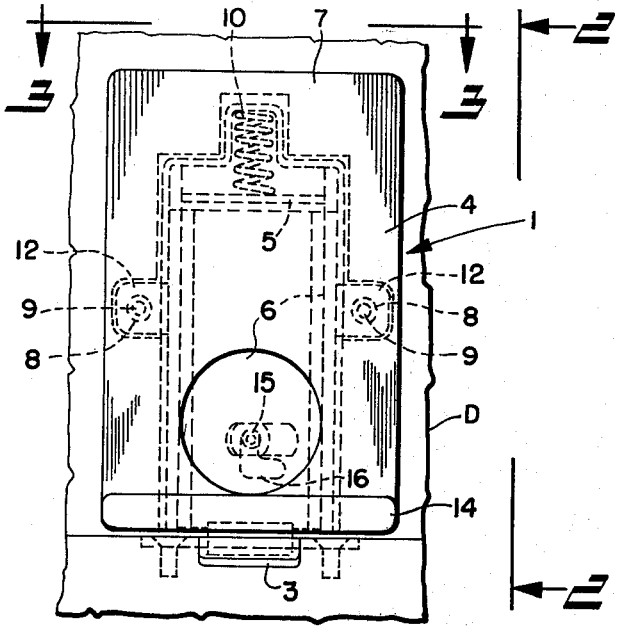
FIG. 1 is a front elevation view of a lock means according to the present invention showing the same mounted on a drawer.
Figure 2:
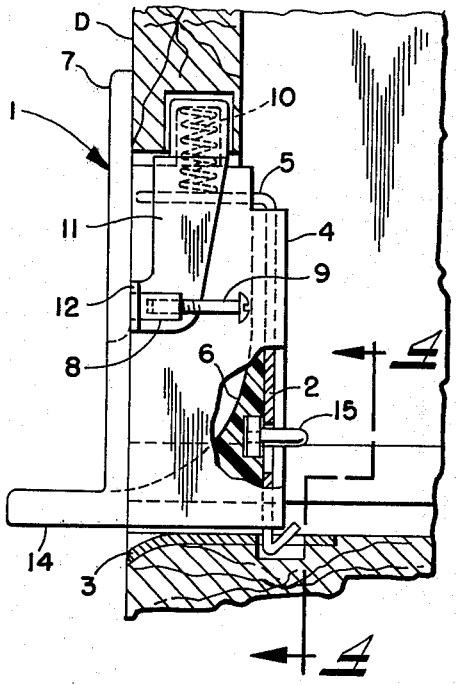
FIG. 2 is a view taken substantially along the line 2—2, FIG. 1.
Figure 3:
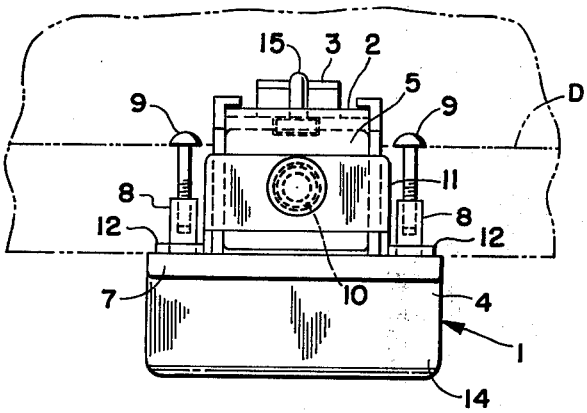
FIG. 3 is a view taken substantially along the line 3—3, FIG. 1.
Figure 4:
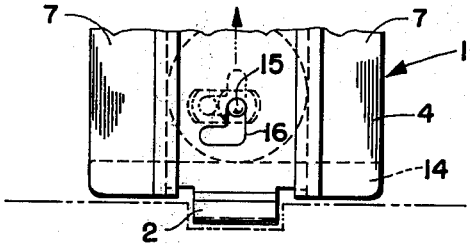
FIG. 4 is a view taken substantially along the line 4—4, FIG. 2.

Referring first to the embodiment of the invention illustrated in FIGS. 1–4, the child-resistant lock means 1 is shown by way of example mounted on the front of a drawer D for engagement and disengagement of a sliding latch 2 with a striker plate 3. The latch 2 is guided for movement in a housing 4 as of molded plastic material, the latch 2 having an angular portion 5 overlying the upper end of an angular passage 6 preferably rounded as shown. The housing 4 has a flange portion 7 overlying the drawer opening and has bosses 8 extending into recesses formed in the drawer front and screws 9 are operative to mount the lock means 1 on the drawer front. The latch 2 is biased to drawer locking position by a spring 10 contained in a spring retainer 11 having ears 12 through which the bosses 8 extend so that the retainer 11 is firmly clamped in place when the screws 9 are tightened.

The housing 4 has a lateral projection 14 adjacent the open end of the angular passage 6 so that the portion 5 of the latch 2 cannot be operated by an elongated slender object such as a stick or pencil.

The angular passage 6 is of size such that when the forefinger of an adult is inserted into the open end of the passage 6, the finger tip will engage the portion 5 to move the latch 2 upwardly against spring pressure to disengage the latch 2 from the striker plate 3. By so actuating the latch 2, the drawer D may readily be pulled out by the vertical portion of the forefinger. When the drawer D is closed, the striker plate 3 will cam the latch 2 upwardly and in the closed position the spring 10 will bias the latch 2 into locking engagement with the striker plate 3.

For retaining the latch 2 in unlocking position, the housing 4 has a pin 15 which normally projects through the vertical portion of an angular slot 16 in the latch 2 to permit vertical locking and unlocking movement of the latch 2 but, when it is desired to maintain the latch 2 in unlatching position, the pin 15 may be shifted horizontally to project through the horizontal portion of the slot 16 to thereby retain the latch 2 in unlatching position.

Although the FIGS. 1–4 embodiment of the invention is shown in conjunction with a drawer D, it is to be understood that the lock means 1 may be mounted on a door, a gate, a cover plate, etc. to prevent unlocking thereof by a young child.

Figure 5:
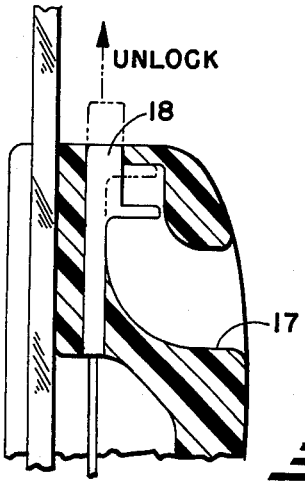
FIG. 5 is a cross-section view of the present lock means as embodied in an automobile door.

In the form of the invention illustrated in FIG. 5, the inside of the door of an automobile has the angular passage 17 therein for movement of a latch actuating plunger 18 upwardly to the dot-dash line position door unlocking position by the tip of the forefinger of an adult. In the locking position of plunger 18, the top thereof is approximately flush as shown so that it cannot be pulled upwardly.

Figure 6:
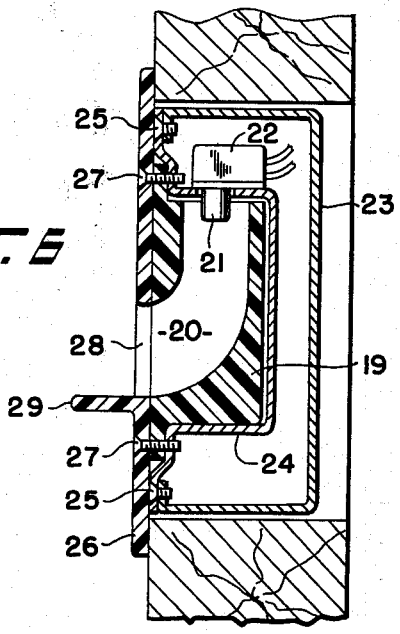
FIG. 6 is a cross-section view of the present lock means in association with an electric switch.

In the FIG. 6 embodiment of the invention, the plastic or like housing 19 has the angular passage 20 therein for insertion of the forefinger of an adult for operation of the switch actuating plunger 21 of an electric switch 22. In this embodiment of the invention, the housing 19 is secured to a conventional outlet box 23 with the switch 22 mounting portion 24 of the housing 19 being secured to the outlet box 23 by the screws 25. The housing cover plate 26 is secured to housing 19 as by the screws 27 with the hole 28 of the cover plate 26 being aligned with the open end of the angular passage 20. The cover plate 26 also has the laterally projecting portion 29 adjacent the open end of the passage 20 and hole 28 to preclude operation of the switch actuating plunger 21 as by a stick or pencil. It is to be understood that the switch 22 may control the operation of electrical apparatus or electric outlets either directly or through a relay.

The embodiments of the invention in which an exclusive property or privilege is claimed are defined as follows:

1. A child-resistant lock means comprising a generally rectangular housing having a flanged front side and having an angular passage in the form of a curved elbow of which one leg is open through said front side for insertion of an adult's forefinger into said one leg and into the other leg which opens through one end of said housing rearward of said flanged front side; a spring-biased locking member longitudinally movable with respect to said housing at the open end of said other leg for movement of said member by the tip of the inserted forefinger, the aggregate length of said legs from the open end of said one leg to the location of said member exceeding the length of a child's forefinger to preclude actuation of said member as aforesaid; and means for securing said housing in recessed relation in a wall, door, drawer, and like opening with the rear side of the flange on said front side engaging the surface bounding such opening.

2. The lock means of claim 1 wherein said housing has a forward lateral projection across said flanged front side and adjacent the open end of said one leg to preclude actuation of said member by the end of a slender stick-like elongated article.

3. The lock means of claim 1 wherein said member is a plunger of an electric switch secured to said housing adjacent to said one end thereof.

4. The lock means of claim 1 wherein said member has a latch portion guided by guideways on the rear side of said housing for movement parallel to said other leg to unlocking relation with respect to a striker plate when said member is moved as aforesaid.

5. The lock means of claim 4 wherein said latch portion has an angular slot therethrough having a longitudinal portion and a lateral portion through which a rearwardly extending retaining pin carried by said housing projects to permit movement of said latch portion in locking and unlocking directions when the retaining pin is in register with the longitudinal portion of said slot; said retaining pin being laterally slidable with respect to said housing for lateral movement into the lateral portion of said slot whereby said latch portion is retained in unlocking position.

* * * * *